US010358934B2

(12) United States Patent
Bifulco

(10) Patent No.: US 10,358,934 B2
(45) Date of Patent: Jul. 23, 2019

(54) METHOD AND APPARATUS FOR ADJUSTING VARIABLE VANES

(71) Applicant: UNITED TECHNOLOGIES CORPORATION, Farmington, CT (US)

(72) Inventor: Anthony R. Bifulco, Ellington, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 671 days.

(21) Appl. No.: 15/095,640

(22) Filed: Apr. 11, 2016

(65) Prior Publication Data

US 2017/0292400 A1 Oct. 12, 2017

(51) Int. Cl.

| | |
|---|---|
| ***F01D 17/08*** | (2006.01) |
| ***F01D 17/16*** | (2006.01) |
| ***F04D 27/02*** | (2006.01) |
| *F04D 29/56* | (2006.01) |

(52) U.S. Cl.

CPC ..... *F01D 17/162* (2013.01); *F01D 17/085* (2013.01); *F04D 27/0246* (2013.01); *F04D 29/563* (2013.01); *F05D 2260/50* (2013.01)

(58) Field of Classification Search

CPC ... F01D 9/02; F01D 9/04; F01D 9/041; F01D 17/08; F01D 17/085; F01D 17/14; F01D 17/16; F01D 17/162; F01D 17/167; F04D 27/0246; F04D 29/563; F05D 2260/50

See application file for complete search history.

(56) References Cited

U.S. PATENT DOCUMENTS 3,632,224 A * 1/1972 Wright ..... F01D 17/162 415/147
4,279,568 A 7/1981 Munroe
5,152,668 A * 10/1992 Bulman ..... B64C 11/32 416/129

(Continued)

FOREIGN PATENT DOCUMENTS

DE 102011055823 A1 5/2012
EP 2990613 A1 3/2016

(Continued)

OTHER PUBLICATIONS

European Search Report for European Patent Application No. 17165334.8, completed Aug. 7, 2017.

*Primary Examiner* — Jason D Shanske
*Assistant Examiner* — Sang K Kim
(74) *Attorney, Agent, or Firm* — Carlson, Gaskey & Olds, P.C.

(57) ABSTRACT

According to one aspect of the present disclosure, a gas turbine engine is disclosed that includes an engine section comprising a plurality of stages of variable vanes, and also includes first and second synchronizing rings (sync-rings). Movement of the first sync-ring adjusts vane angles of a first one of the stages of variable vanes, and movement of the second sync-ring adjusts vane angles of a second one of the stages of variable vanes. At least one sensor is configured to measure a condition of the gas turbine engine. A controller is configured to move the first sync-ring independently of the second sync-ring based on data from the at least one sensor.

18 Claims, 5 Drawing Sheets

(56) References Cited

U.S. PATENT DOCUMENTS 5,630,701 A * 5/1997 Lawer ..... F01D 17/162 415/160
5,993,152 A * 11/1999 Schilling ..... F01D 17/162 415/155
7,232,287 B2 * 6/2007 Regunath ..... G05B 13/021 415/160
7,588,415 B2 9/2009 Giaimo et al.
7,922,445 B1 4/2011 Pankey et al.
8,240,983 B2 * 8/2012 Suljak, Jr. ..... F01D 17/162 415/160
8,534,996 B1 * 9/2013 Pankey ..... F01D 11/22 415/127
8,905,887 B2 * 12/2014 Coles ..... F01D 17/20 475/162
10,012,102 B2 * 7/2018 Teixeira ..... F01D 17/12
10,060,285 B2 * 8/2018 Do ..... F01D 17/162
10,060,286 B2 * 8/2018 Izquierdo ..... F01D 17/162
10,132,191 B2 * 11/2018 Surace ..... F01D 9/065
2005/0135926 A1 6/2005 Selby
2007/0031238 A1 * 2/2007 Fujii ..... F02C 9/20 415/48
2010/0021285 A1 * 1/2010 Rowe ..... F01D 17/162 415/125
2010/0260591 A1 10/2010 Martin et al.
2012/0134783 A1 * 5/2012 Davidson ..... F04D 27/0246 415/148
2012/0259528 A1 * 10/2012 Minto ..... F01D 17/16 701/100
2017/0276147 A1 * 9/2017 Suciu ..... F04D 29/563

FOREIGN PATENT DOCUMENTS

WO 2014189574 A2 11/2014
WO 2014189578 11/2014

* cited by examiner

METHOD AND APPARATUS FOR ADJUSTING VARIABLE VANES

BACKGROUND

This disclosure relates to gas turbine engines, and more particularly to adjusting vane angles of variable vanes in a gas turbine engine.

Gas turbine engines typically include a compressor section, a combustor section, and a turbine section. In general, during operation, air is pressurized in the compressor section and is mixed with fuel and burned in the combustor section to generate hot combustion gases. The hot combustion gases flow through the turbine section, which extracts energy from the hot combustion gases to power the compressor section and other gas turbine engine loads.

Some areas of a gas turbine engine may include variable vanes that are circumferentially spaced apart from each other. The compressor, for example, may include multiple stages of variable vanes that are axially separated from each other by rotor blades. In some compressor designs, the stages of variable vanes are mechanically connected to respective synchronizing rings (sync-rings) by vane arms. The sync-rings rotate clockwise and counterclockwise circumferentially around the compressor case to pivot the vane arms and set vane angles that optimize engine operability (e.g., preventing stalling and/or buffeting) and engine performance (e.g., maximizing thrust and/or minimizing fuel consumption). During operation, an actuation system drives the sync-rings.

Variable vane actuation systems have traditionally relied on linked multistage adjustment structures that, when actuated, simultaneously adjust each of a plurality of stages of variable vanes through a shared torque box as a single point of actuation. In such arrangements, adjustment of a first stage of variable vanes necessarily also adjusts the other linked stages, because as a given sync-ring is rotated in a circumferential direction around the engine, the other sync-rings are also circumferentially rotated in a pre-established proportion. Separate actuators have also been proposed.

SUMMARY

One example embodiment of a gas turbine engine includes an engine section comprising a plurality of stages of variable vanes, and first and second synchronizing rings (sync-rings). Movement of the first sync-ring adjusts vane angles of a first one of the stages of variable vanes, and movement of the second sync-ring adjusts vane angles of a second one of the stages of variable vanes. At least one sensor is configured to measure a condition of the gas turbine engine. A controller is configured to move the first sync-ring independently of the second sync-ring based on data from the at least one sensor.

In another example embodiment of the above described gas turbine engine, a first actuator is configured to rotate the first sync-ring, and a different, second actuator is configured to rotate the second sync-ring. To move the first sync-ring independently of the second sync-ring, the controller is configured to actuate the first actuator independently of the second actuator.

In another example embodiment of any of the above described gas turbine engines, the first and second actuators are electric actuators.

In another example embodiment of any of the above described gas turbine engines, each sync-ring comprises first gear teeth situated on a first side of the sync-ring that engage an actuator gear of the actuator; and second gear teeth situated on an opposite, second side of the sync-ring that engage vane gears of the stage of variable vanes associated with the sync-ring.

In another example embodiment of any of the above described gas turbine engines, the second stage of variable vanes is aft of the first stage of variable vanes, and permits a smaller range of vane angle adjustment than the first stage.

In another example embodiment of any of the above described gas turbine engines, the at least one sensor includes a pressure sensor.

In another example embodiment of any of the above described gas turbine engines, the at least one sensor includes a temperature sensor.

In another example embodiment of any of the above described gas turbine engines, the at least one sensor includes a sensor situated at an inlet or an outlet of the engine section.

In another example embodiment of any of the above described gas turbine engines, the engine section is a compressor.

In another example embodiment of any of the above described gas turbine engines, the engine section is a turbine.

One example embodiment of a method for adjusting variable vanes of a gas turbine engine includes obtaining sensor data that indicates a condition of the gas turbine engine, and moving a first sync-ring independently of a second sync-ring based on the sensor data. The first and second sync-rings are part of an engine section that comprises a plurality of stages of variable vanes. Movement of the first sync-ring adjusts vane angles of a first one of the stages of variable vanes, and movement of the second sync-ring adjusts vane angles of a second one of the stages of variable vanes.

In another example embodiment of the above described method, moving the first sync-ring independently of the second sync-ring comprises rotating the first sync-ring independently of the second sync-ring.

In another example embodiment of any of the above described methods, rotating the first sync-ring independently of the second sync-ring comprises controlling a first actuator to rotate the first sync-ring independently of a second actuator that is configured to rotate the second sync-ring.

In another example embodiment of any of the above described methods, each actuator is an electrical actuator, and controlling each actuator to rotate its associated sync-ring comprises applying a voltage to the actuator.

In another example embodiment of any of the above described methods, rotating the first sync-ring independently of the second sync-ring comprises rotating an actuator gear that engages first gear teeth situated on a first side of the sync-ring, and thereby rotates both the sync-ring and vane gears that engage second gear teeth on an opposite, second side of the sync-ring.

In another example embodiment of any of the above described methods, the second stage of variable vanes is aft of the first stage of variable vanes, and permits a smaller range of vane angle adjustment than the first stage.

In another example embodiment of any of the above described methods, obtaining sensor data that indicates a condition of the gas turbine engine comprises measuring a pressure of the gas turbine engine.

In another example embodiment of any of the above described methods, obtaining sensor data that indicates a condition of the gas turbine engine comprises measuring a temperature of the gas turbine engine.

In another example embodiment of any of the above described methods, obtaining sensor data that indicates a condition of the gas turbine engine comprises performing a measurement at an inlet or an outlet of the engine section.

In another example embodiment of any of the above described methods, the engine section is a compressor or a turbine.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

Figure 1:
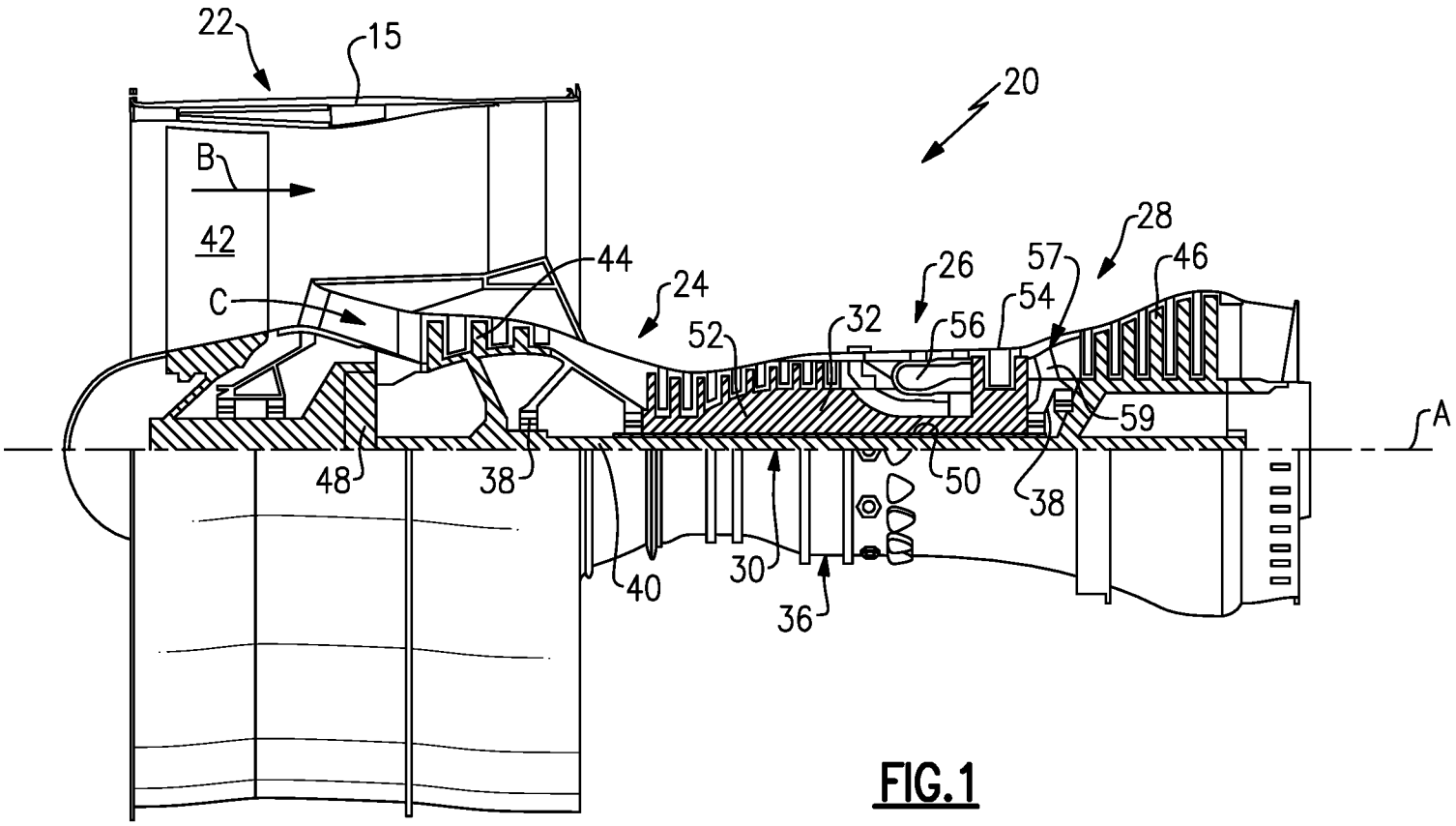
FIG. 1 illustrates a schematic, cross-sectional view of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
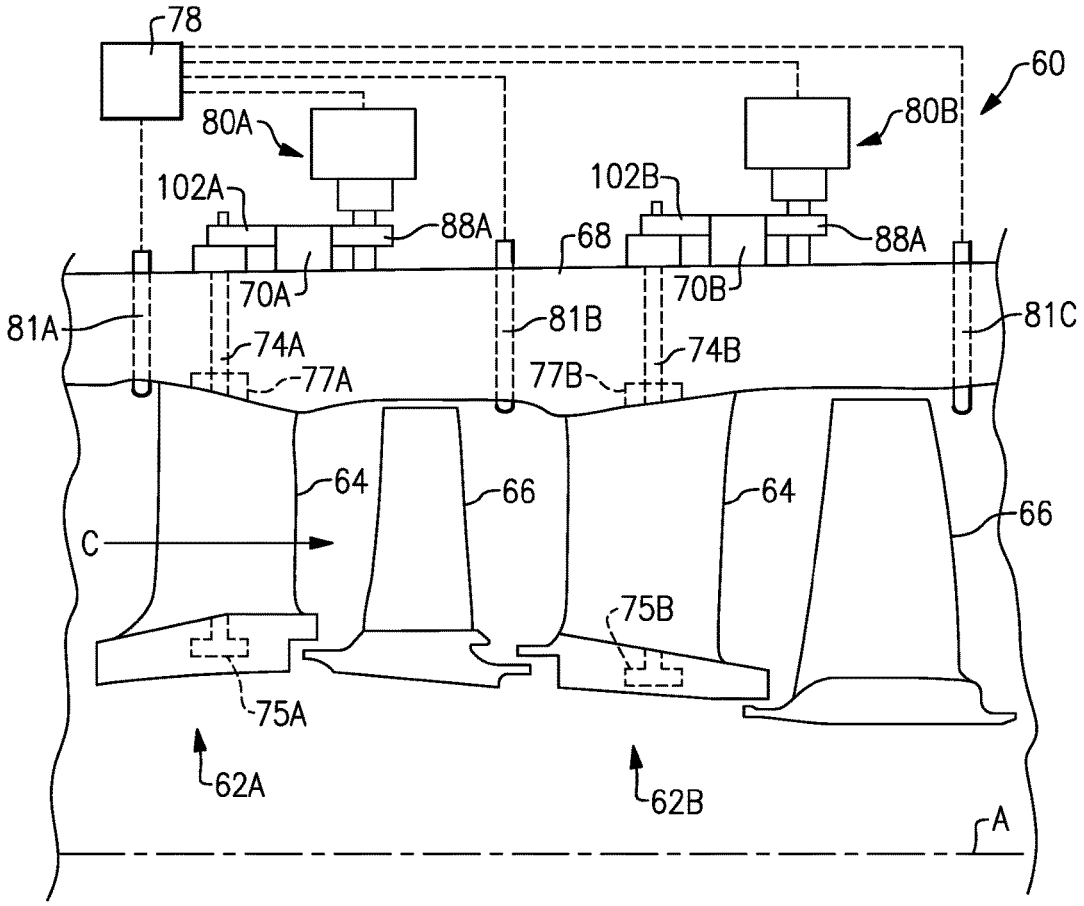
FIG. 2 illustrates schematic, cross-sectional view of an engine section of the gas turbine engine of FIG. 1.

FIG. 2 illustrates a schematic, cross-sectional view of an engine section 60 that includes a plurality of stages 62 of variable stator vanes 64 that extend radially outward from engine central longitudinal axis A, and are axially separated by rotor blades 66. The engine section 60 may be part of the low pressure compressor 44, high pressure compressor 52, low pressure turbine 46, or high pressure turbine 54, for example. A case 68 surrounds the engine section 60.

The variable vanes 64 are mechanically linked to sync-rings 70 that are situated outside of the case 68. A plurality of electric actuators 80 include respective gears 88 that engage the sync-rings 70, causing the sync-rings 70 to rotate circumferentially about the case 68. In this configuration, the gears 88 act as racks and the sync-rings 70 act as pinions. The sync-rings 70 also engage vane gears 102 to adjust the vane angles of variable vanes 64. The vane gears 102 are connected to the variable vanes 64 via extensions 74. Circumferential rotation of the sync-rings 70 about the case 68 causes the variable vanes 64 (and their extensions 74) to pivot, and thereby change the vane angles of the variable vanes 64. Each variable vane 64 has a respective inner trunnion 75 and outer trunnion 77 that guide rotation of their associated variable vane 64.

In the example of FIG. 2, rotation of the sync-ring 70A adjusts vane angles of the first stage 62A of variable vanes 64, and rotation of sync-ring 70B adjusts vane angles of the second stage 62B of variable vanes 64. The sync-rings 70A-B are actuated by their own respective actuators 80A-B, enabling the sync-rings 70A-B to be rotated independently of each other. Additional stages 62 of variable vanes (not shown) may also be included, and may also include their own respective sync-rings 70 and actuators 80 (which may also be electric). A perspective view of the engine section 60, sync-rings 70, and actuators 80 of engine section 60 is provided in FIG. 3.

A controller 78 is operatively connected to at least one sensor 81 that is configured to measure a condition of the gas turbine engine 20, such as pressure or temperature. FIG. 2 depicts three example locations for sensors 81A-C. In one example, sensor 81A is situated at an inlet of the engine section 60 (e.g., an inlet of low pressure compressor 44 or high pressure compressor 52). In one example, sensor 81C is situated at an outlet of the engine section 60 (e.g., an outlet of low pressure compressor 44 or high pressure compressor 52). Sensor 81B is situated at an intermediate location between the stages 62A-B of variable vanes 64. Any one of these sensor locations may be used either alone, or in any combination. Of course, it is also understood that other sensor locations could be used.

The controller 78 is also operatively connected to the actuators 76A-B, which as discussed above may be electric actuators. The controller 78 is configured to use the actuators 80A-B to rotate the sync-rings 70A-B independently of each other based on data from the at least one sensor 81. Incorporating a separate actuator 80 for each stage 62 of variable vanes 64 enables independent angle adjustment of each stage 62. The controller 78 includes control logic for optimizing the operating angle of each stage 62 of variable vanes 64 as the gas turbine engine 20 operates. In some embodiments, use of electric actuators 80 rather than hydraulic actuators may provide for more accurate control of the vane angles of the variable vanes 64.

Prior art configurations permitted varying degrees of rotation of stages of variable vanes, but these rotations were not independent of each other. Instead, these prior art arrangements made compromises to the vane angles selected and the accuracy achieved in order to provide motion via a single actuator. The arrangement described in FIG. 2, in contrast, can be used to independently optimize vane angles without being constrained by the limitations of the prior art, enabling independent and optimized efficiency of vane angles of the variable vanes 64.

It may be beneficial, for example, to adjust certain vane angles while other vane angles remain unchanged. Also, the feedback from sensor(s) 81 could be used to fine tune angle adjustments based on actual engine operating conditions, instead of constraining relative vane angles based on predicted conditions of a gas turbine engine.

Still further, different engine operating conditions (e.g., cruise and descent) may benefit from having different combinations of vane angles that would not be possible with the constrained adjustments of the prior art. In this regard, the independent vane angle adjustments described herein could be used to increase engine efficiency. Engine efficiency is understood as depending on a relationship between compressor pressure and temperature. Different combinations of vane angles could be tested to determine optimal angles during various operating conditions to achieve a desired pressure-to-temperature relationship.

Omission of the multi-stage linkage of the prior art coupled with the use of independent adjustment of different stages of variable vanes may in some embodiments also provide increased stability for the engine section 60, decreased engine weight, and/or decreased fuel consumption.

In one or more embodiments, the various stages 62 of variable vanes 64 have different ranges of rotation, such that stages 62 closer to a fore side of the engine section 60 have a greater range of possible vane angles than stages 62 closer to an aft side of the engine section 60. One reason for this is that in some instances, different ones of the variable vanes 62 in an engine section may have different roles (e.g., a foremost inlet vane stage 62 may have greater control over the volume of air that is communicated to the combustor, whereas later stages 62 have less control over air volume). The independent actuator arrangement described above can accommodate such varying ranges without requiring the prior art linkages that would otherwise be used to dependently co-rotate the sync-rings 70 with each other.

As discussed above, the example sensor locations shown for the sensors 81A-C could be used individually or in any combination. Thus, in some embodiments, multiple sensors 81 could be used at multiple locations and/or to measure different parameters. It is further understood that pressure and temperature are only non-limiting example parameters that could be measured. In one or more embodiments, one or more of the sensors 81 is a major station probe (e.g., situated at station 2.5 or station 3.0).

Figure 3:
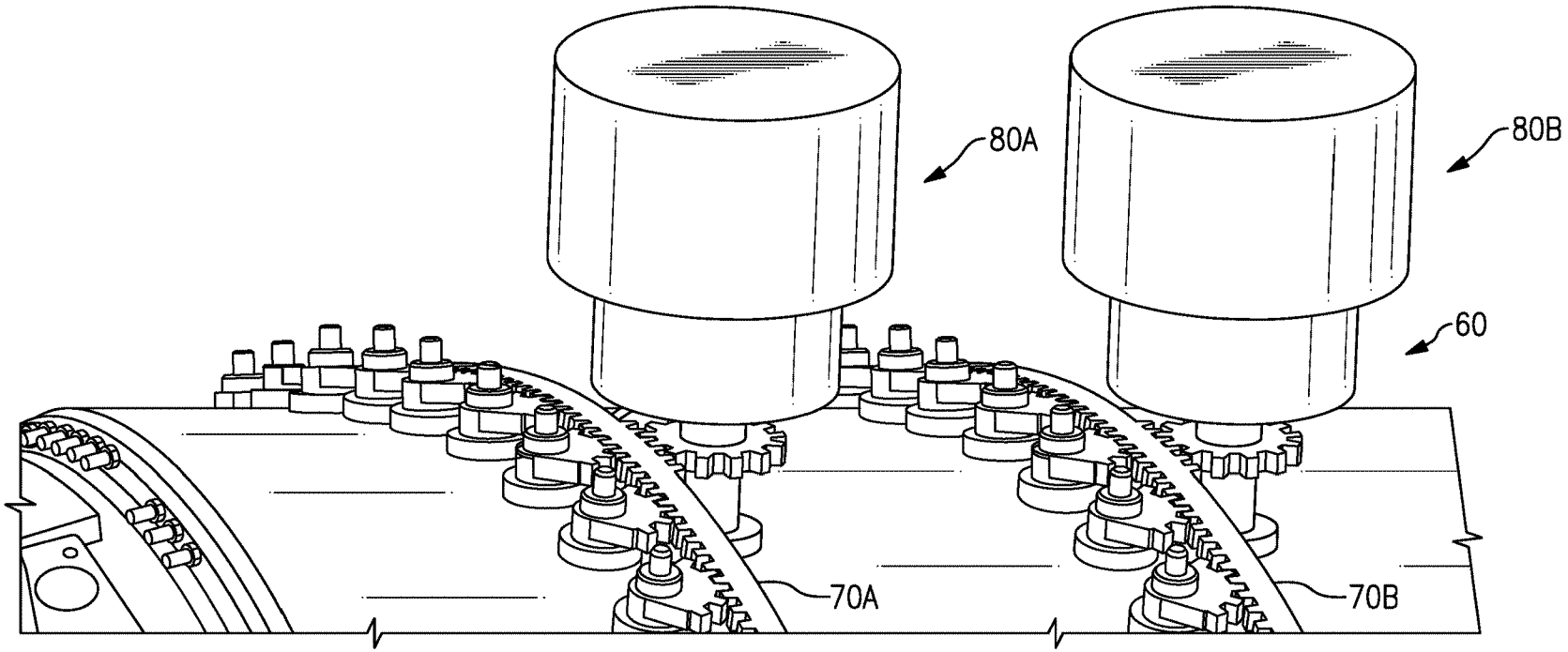
FIG. 3 is a perspective view of a portion of the engine section of FIG. 3.

Also, although two stages 62 of variable vanes 64 are shown in FIGS. 2 and 3, it is understood that this is only a non-limiting example, and that any number of stages could be used. In some embodiments, there may be three or more stages 62 of variable vanes 64 that each have their own respective actuator 80 and sync-ring 70 that are rotatable independently of each other. In other embodiments, some stages 62 have their own actuators 80 and are rotatable independently of each other, and other stages 62 share an actuator and rotate dependently as in the prior art. It is also understood that other types of sync-rings 70 and actuators 80 could be used than those depicted in FIGS. 2-3. In some embodiments, an engine section may include a single stage of variable vanes that use the sync-ring configuration depicted in FIGS. 2-3, and may also include one or more stages of vanes that are fixed and non-variable.

Figure 4:
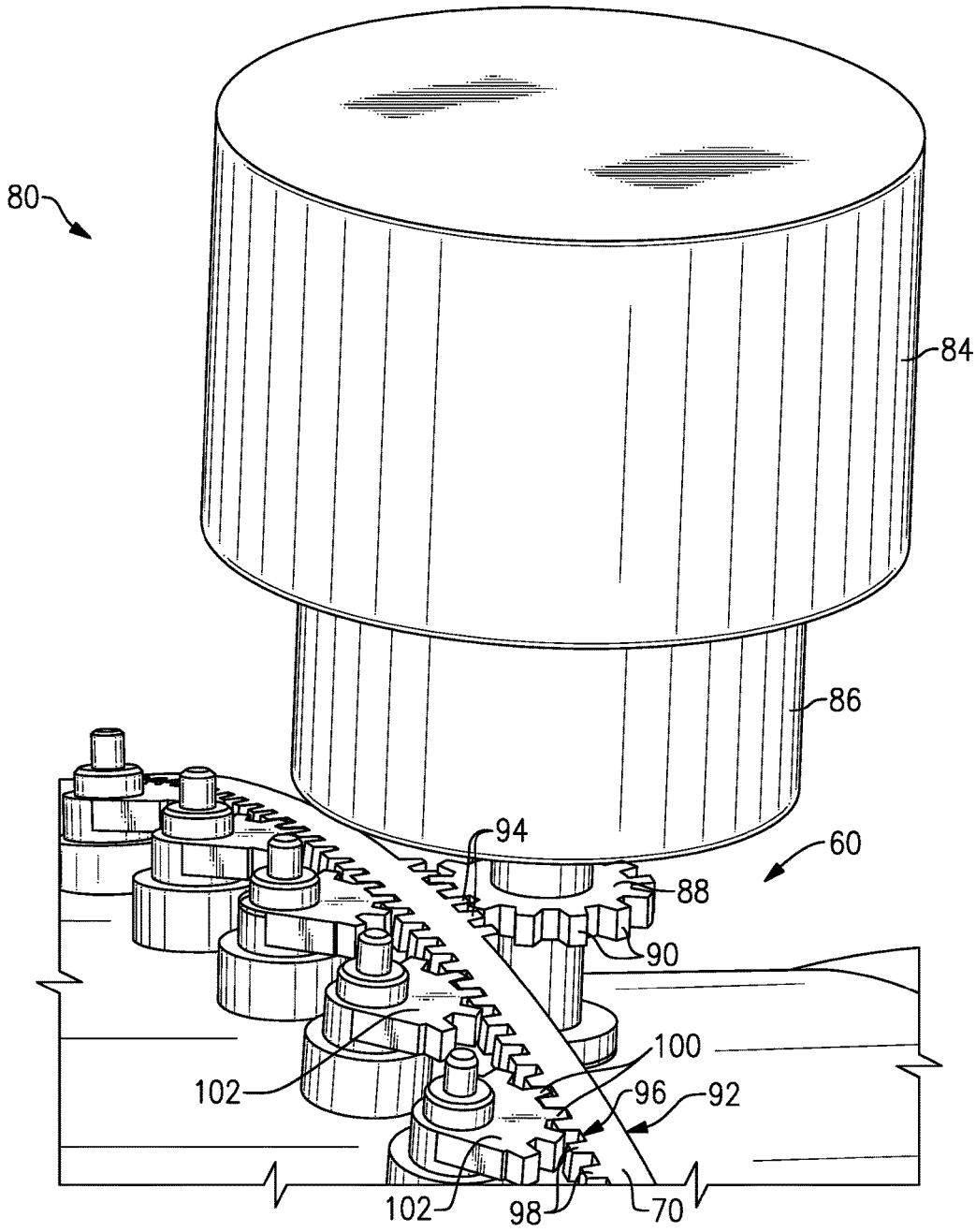
FIG. 4 schematically illustrates a portion of FIG. 3 in greater detail.

FIG. 4 schematically illustrates a portion of FIG. 3 in greater detail. As shown in FIG. 4, the actuator 80 includes an electric motor 84, reduction gear 86, and actuator gear 88.

The reduction gear 86 permits actuator gear 88 to rotate at a lower rotational speed but a higher torque than the electric motor 84. The actuator gear 88 includes gear teeth 90.

The sync-ring 70 includes a first side 92 from which first gear teeth 94 extend, and also includes an opposite, second side 96 from which gear teeth 98 extend. The first gear teeth 94 engage the gear teeth 90 of the actuator gear 88, in a rack and pinion configuration. The second gear teeth 98 engage gear teeth 100 of vane gears 102. Rotation of the electric motor 84 drives rotation of actuator gear 88, which rotates sync-ring 70 and vane gears 102. Although only one sync-ring 70 is depicted in FIG. 4 for a single stage of vanes, it is understood that multiple stages could be utilized (e.g., as depicted in FIGS. 2-3 and as discussed above).

The quantity of gear teeth 100 included in a given vane gear 102 could be selected based on how much rotation of its corresponding vane is desired (e.g., more gear teeth at a foremost stage to permit greater rotation, and less gear teeth at an aft stage to permit less rotation).

Figure 5:
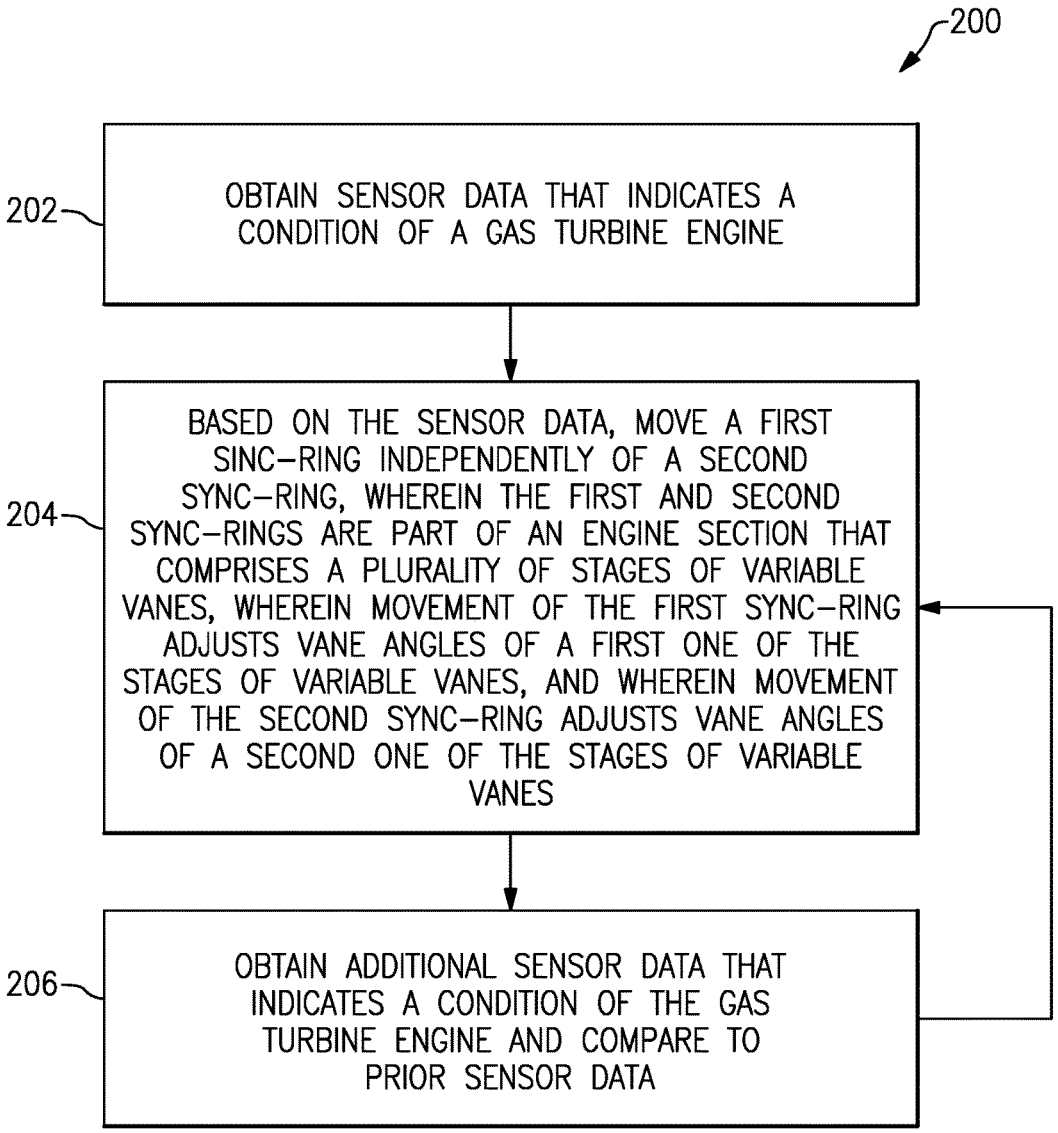
FIG. 5 is a flowchart of a method for adjusting variable vanes of a gas turbine engine.

FIG. 5 is a flowchart of a method 200 for adjusting variable vanes 64 of a gas turbine engine 20. Sensor data is obtained (block 202) that indicates a condition of the gas turbine engine 20. In one example, the condition is a temperature or pressure of the engine and/or its components (e.g., the low pressure compressor 44, high pressure compressor 52, low pressure turbine 46, or high pressure turbine 54, or a combination thereof. Based on the sensor data, a first sync-ring 70 is moved independently of a different, second sync-ring 70 (block 204). The first and second sync-rings 70 are part of an engine section 60 that comprises a plurality of stages 62 of variable vanes 64, wherein movement of the first sync-ring 70 adjusts vane angles of a first one of the stages 62 of variable vanes 64, and movement of the second sync-ring 70 adjusts vane angles of a second one of the stages 62 of variable vanes 64.

Optionally, additional sensor data may be obtained that indicates a condition of the gas turbine engine (block 206), and that additional sensor data may be compared to prior sensor data. Blocks 204-206 may then be iteratively repeated to perform a continuous optimization of vane angles. The "prior sensor data" of block 206 may include the sensor data from block 202, for example, and/or may include historical sensor data obtained in a test environment from a different gas turbine engine.

Although example embodiments have been disclosed, a worker of ordinary skill in this art would recognize that certain modifications would come within the scope of this disclosure. For that reason, the following claims should be studied to determine the true scope and content of this disclosure.

I claim:

1. A gas turbine engine comprising:

an engine section comprising a plurality of stages of variable vanes;

first and second synchronizing rings (sync-rings), wherein movement of the first sync-ring adjusts vane angles of a first one of the stages of variable vanes, and movement of the second sync-ring adjusts vane angles of a second one of the stages of variable vanes;

at least one sensor configured to measure a condition of the gas turbine engine; and a controller configured to move the first sync-ring independently of the second sync-ring based on data from the at least one sensor;

wherein the second stage of variable vanes is aft of the first stage of variable vanes, and permits a smaller range of vane angle adjustment than the first stage.

2. The gas turbine engine of claim 1, comprising:

a first actuator configured to rotate the first sync-ring, and a different, second actuator configured to rotate the second sync-ring;

wherein to move the first sync-ring independently of the second sync-ring, the controller is configured to actuate the first actuator independently of the second actuator.

3. The method of claim 2, wherein the first and second actuators are electric actuators.

4. The gas turbine engine of claim 2, wherein each sync-ring comprises:

first gear teeth situated on a first side of the sync-ring that engage an actuator gear of the actuator; and second gear teeth situated on an opposite, second side of the sync-ring that engage vane gears of the stage of variable vanes associated with the sync-ring.

5. The gas turbine engine of claim 1, wherein the at least one sensor includes a pressure sensor.

6. The gas turbine engine of claim 1, wherein the at least one sensor includes a temperature sensor.

7. The gas turbine engine of claim 1, wherein the at least one sensor includes a sensor situated at an inlet or an outlet of the engine section.

8. The gas turbine engine of claim 1, wherein the engine section is a compressor.

9. The gas turbine engine of claim 1, wherein the engine section is a turbine.

10. A method for adjusting variable vanes of a gas turbine engine comprising:

obtaining sensor data that indicates a condition of the gas turbine engine; and moving a first synchronizing ring (sync-ring) independently of a second sync-ring based on the sensor data;

wherein the first and second sync-rings are part of an engine section that comprises a plurality of stages of variable vanes, wherein movement of the first sync-ring adjusts vane angles of a first one of the stages of variable vanes, and wherein movement of the second sync-ring adjusts vane angles of a second one of the stages of variable vanes;

wherein the second stage of variable vanes is aft of the first stage of variable vanes, and permits a smaller range of vane angle adjustment than the first stage.

11. The method of claim 10, wherein said moving the first sync-ring independently of the second sync-ring comprises rotating the first sync-ring independently of the second sync-ring.

12. The method of claim 11, wherein rotating the first sync-ring independently of the second sync-ring comprises controlling a first actuator to rotate the first sync-ring independently of a second actuator that is configured to rotate the second sync-ring.

13. The method of claim 12, wherein each actuator is an electrical actuator, and controlling each actuator to rotate its associated sync-ring comprises applying a voltage to the actuator.

14. The method of claim 12, wherein rotating the first sync-ring independently of the second sync-ring comprises rotating an actuator gear that engages first gear teeth situated on a first side of the sync-ring, and thereby rotates both the sync-ring and vane gears that engage second gear teeth on an opposite, second side of the sync-ring.

15. The method of claim 10, wherein obtaining sensor data that indicates a condition of the gas turbine engine comprises measuring a pressure of the gas turbine engine.

16. The method of claim 10, wherein obtaining sensor data that indicates a condition of the gas turbine engine comprises measuring a temperature of the gas turbine engine.

17. The method claim 10, wherein obtaining sensor data that indicates a condition of the gas turbine engine comprises performing a measurement at an inlet or an outlet of the engine section.

18. The method of claim 10, wherein the engine section is a compressor or a turbine.

* * * * *